US010738770B2

(12) United States Patent
Teylor

(10) Patent No.: US 10,738,770 B2
(45) Date of Patent: Aug. 11, 2020

(54) ISOLATED CHAMBER PUMP WITH RECIRCULATION OF LEAKAGES

(71) Applicant: Adrian Alberto Teylor, Barcelona (ES)

(72) Inventor: Adrian Alberto Teylor, Barcelona (ES)

( * ) Notice: Subject to any disclaimer, the term of this patent is extended or adjusted under 35 U.S.C. 154(b) by 80 days.

(21) Appl. No.: 15/477,096

(22) Filed: Apr. 2, 2017

(65) Prior Publication Data

US 2017/0298916 A1 Oct. 19, 2017

(30) Foreign Application Priority Data

Apr. 16, 2016 (ES) ..... 201630476 U

(51) Int. Cl.

| | |
|---|---|
| ***F04B 17/04*** | (2006.01) |
| ***F04B 53/14*** | (2006.01) |
| ***F04B 1/0443*** | (2020.01) |
| ***F01M 1/02*** | (2006.01) |

(52) U.S. Cl.

CPC ..... *F04B 17/044* (2013.01); *F04B 17/042* (2013.01); *F04B 53/143* (2013.01); *F01M 2001/0223* (2013.01); *F04B 1/0443* (2013.01); *F04B 53/14* (2013.01); *F04B 2201/0208* (2013.01)

(58) Field of Classification Search

CPC ..... F04B 43/046; F04B 17/04–048; F04B 1/0443; F04B 53/04; F04B 53/143; F04B 53/16–162; F04B 2001/0223–023; F04B 2201/0208

USPC ... 417/413.1, 413.2, 410.1, 415–417, 423.11

See application file for complete search history.

(56) References Cited

FOREIGN PATENT DOCUMENTS

| | | | | |
|---|---|---|---|---|
| DE | 102007007297 A1 * | 8/2008 | ..... | F04B 35/045 |
| DE | 102012202720 A1 * | 8/2013 | ..... | F04B 1/0408 |
| DE | 102012024640 A1 * | 6/2014 | ..... | F04B 53/14 |
| GB | 993390 A * | 5/1965 | ..... | F04B 17/042 |

* cited by examiner

*Primary Examiner* — Alexander B Comley

(57) ABSTRACT

Vibrating pump with a secondary closed circuit designed for the recovery and reinjection of the fluid that can eventually escape from the compression chamber and which, if not collected, would end up in the force chamber affecting the drive elements (springs, magnetic core) and therefore the proper functioning and useful life of the pump.

3 Claims, 2 Drawing Sheets

ISOLATED CHAMBER PUMP WITH RECIRCULATION OF LEAKAGES

BACKGROUND

The present invention relates to a vibrating pump with an isolated compression chamber, comprising a plunger as a compression/driving means, alternately moved by a magnetic system constituted by an electromagnet, in which said plunger pumps the liquid in a compression chamber from an inlet to an outlet. The vibrating pump of this invention has features designed to reduce the risk of leakage from the compression chamber to the force chamber and at the same time to increase the efficiency in the transformation of the electromagnetic energy into hydraulic energy of this type of pumps. The improvements concern the magnetic core/plunger assembly and the configuration of the compression chamber, which allows to obtain better results than the current pumps with less copper and to reduce the consumption of electric energy during its operation.

Various pressure pumps are known and used to moving liquids from one point to another, for example gear pumps, centrifugal pumps, vane pumps, vibratory pumps, etc.

The piston or membrane vibratory pumps, which are of the type to which the present invention relates, have an operation based on alternately displacing a magnetic core with the use of an electromagnet disposed around said core. The use of an alternative electric power generates magnetic pulses that cause the magnetic core to tend to be centered within the magnetic field produced by the electromagnet and a back-positioned spring fulfills the function of moving the magnetic core back again from this magnetic position of equilibrium producing the alternative movement of the magnetic core and the pumping work.

The magnetic and hydraulic system used by isolated chamber vibrating pumps of the type mentioned in DE102007007297 and U201400676 can have their efficiency improved and this is due to the failure of taking advantage of all the opportunities presented by this hydraulic-magnetic configuration, such as to reduce the friction load of the o-rings over the plunger.

The above-mentioned isolated chamber pumps need excellent sealing of the compression chamber to prevent water leakages to the magnetic system. A high load of the seal elements is necessary to achieve this degree of tightness over the plunger, o-rings for example, and the plunger moves at high speeds relative to said seals. Increasing the load of the seals over the plunger also increases the brake effect to its alternative movement and requires a greater magnetic force to move it resulting in more copper used in the coil. In today's isolated chamber pumps, reducing the seal load to the lower limit for achieve less friction and therefore lowering the copper amount in the coil is not possible because during work the water that would inevitably leak from the compression chamber would end in the force chamber or on the outside of the pump.

Even in the scenario where water leakage is compatible with the pump application, this alternative of reducing this seal load to reduce pump-manufacturing costs requires other collateral costs such as means for directing said water leakages away of the electrical parts of both the pump and the appliance that uses the pump. A further disadvantage of minimizing the sealing load is aesthetic as these water losses must be led to evaporation vessels to prevent them from coming out of the appliance and being perceived by the end customer.

Another important element in this sensible balance between the pressure exerted by the seals and the risk of water leakage is the material of the plunger on which these sealing seals work. Two factors affect this equilibrium: a—the change of diameter of the plunger with the humidity and/or temperature and b—the finishing of the plunger's surface. The modification of the diameter of the plunger alters the relative load of the seals and therefore increases the magnetic force necessary to move it or increases the leaks in the opposite case. The roughness of the plunger determines the life expectancy of the seals and consequently affects the lead-time to observe the first leaks and the quantity of water leaked. In order to keep these variables under control the selection of the material used for manufacturing the plunger is of vital relevance, the objective being to use a material that allows an excellent surface finishing and that does not modify its dimensions under the effects of temperature and humidity.

Therefore, the technical problem that arises is the introduction of substantial improvements to current isolated chamber pumps, thus solving some of the implicit drawbacks of this pumping technology while reducing material costs, mainly copper and steel, and manufacturing.

SUMMARY

To facilitate the understanding of the description two systems are identified in the pump of this invention, one being called the electromagnetic system and the other being called the hydraulic system.

The electromagnetic system consists of a coil, a metal frame, a rear bolt, two metal bushings, a non-magnetic separator, a force spring, a compensation spring and a magnetic core. The magnetic core is displaced axially and reciprocally by the pulsating magnetic excitation of the electromagnet within the so-called force chamber (12), which is bounded on the left-hand side by the rear bolt (8), externally by two ferro-magnetic bushings (10, 11) and the non-magnetic separator (9), and on the right-hand side by the sealing seals (18, 19) of the leak recovery chamber (16). The electromagnetic system is identified by the box 1

The hydraulic system is composed of a hydraulic head (3) with an inlet (4) and a water outlet (5), sealing seals (17) that limit and separate the compression chamber (15) from the leak recovery chamber (16). Other seals (18, 19) separate the leak recovery chamber (16) from the force chamber (12) and a plunger (14) extending from the magnetic core (13) passes through the leak recovery chamber (16) to terminate inside the compression chamber (15) for performing the pumping work. Finally, the leaking water recirculation tube (20) connects the leak recovery chamber (16) to the inlet of the hydraulic head (3). The hydraulic system is identified by box 2

The vibrating pump for liquids, subject of this invention, comprises: a hydraulic head (3) provided with an inlet (4) and a liquid outlet (5); Liquid pumping means constituted by two springs (27, 28) and a plunger (14) attached to a magnetic core (13); An electromagnet provided with a ferromagnetic frame (7) integrating a rear bolt (8), two ferromagnetic bushings (10, 11), a non-magnetic separator (9) and a coil (6), suitable to move in an axial direction and an alternative sense the magnetic core (13) inside the force chamber (12) which is aligned with the compression chamber (15); Presents characteristics, according to the claims that allow solving the problems discussed above and provide a series of advantages of both use and manufacture.

According to the invention, this vibrating pump has a first feature which consists in that the water, which may eventually leak from the compression chamber (15) through the seal (17) that hold the working pressure, is collected by the leak recovery chamber (16) that is bounded on the right-hand side by the pressure seal (17) and on the left-hand side by the sealing seals (18, 19); that this leak recovery chamber is communicated by the tube (20) with the inlet (4) of the hydraulic head (3) and that the water eventually leak through the pressure seal (17) is drawn by the pump itself and reinjected into the main circuit of the liquid by the compression chamber (15).

Another embodiment according to this invention consists of a leak recovery chamber (16) having a membrane (22) which seals on the plunger (14) in its inner diameter and that seals on the hydraulic head (3) in its outer diameter and that separates said leak recovery chamber (16) from the force chamber (12).

The use of a membrane (22) guarantees the complete tightness of the hydraulic system towards the magnetic system.

A second feature of the vibrating pump of this invention is the plunger (14) made of materials that do not modify their mechanical characteristics with the working temperatures and humidity typical of vibrating pumps for liquids. At present vibrating pumps do not use materials suitable for these requirements, probably because of their fragility, such as glass or ceramics. According to the invention, a ceramic plunger (14) is linked to a ferromagnetic core (13) through an over-molding or gluing process, resulting in a compact, vibration-resistant assembly compatible with any type of liquid to pump.

The features of the invention will be more readily understood in view of the exemplary embodiment shown in the appended figures.

DESCRIPTION OF THE DRAWINGS

In order to complement the description that is being made and in order to facilitate the understanding of the characteristics of the invention, accompanying to the present specification are figures that, with illustrative and non-limiting character, have been represented as follows.

DETAILED DESCRIPTION

Figure 1:
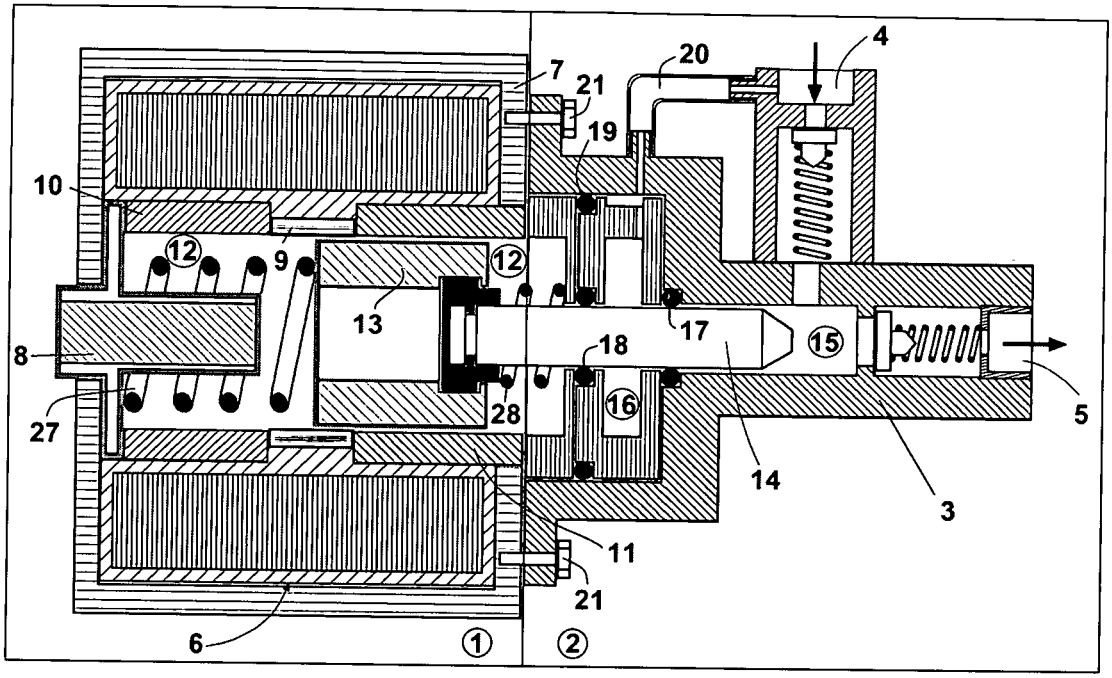
FIG. 1 shows a schematic drawing of an exemplary embodiment of the vibrating pump for liquids according to the invention, sectioned in a vertical plane.

In the exemplary embodiment shown in FIG. 1 the vibrating pump for liquids comprises a hydraulic system (2) consisting of a hydraulic head (3) with an inlet (4) and an outlet (5) for the liquid, said hydraulic head (3) is joined by the screws (21) to the electromagnetic system (1) composed of the metal frame (7) which integrates the rear bolt (8) and it is situated around the coil (6) which at its turn is located around the bushings (9, 10, 11) constituting the force chamber (12) through which the magnetic core (13) positioned between two springs (27, 28) moves in axial direction and alternative sense and said magnetic core (13) extends in the plunger (14) inside the compression chamber (15) through the leak recovery chamber (16).

According to the invention, and as shown in FIG. 1, the leak recovery chamber (16), which is limited by the pressure seal (17) on the right-hand side and by the sealing seals (18, 19) on the left-hand side, recovers any losses of water from the compression chamber (15) and conduct it through the conduit (20) to the inlet (4) of the compression chamber (15) which draws in and re-infuses the water from the leak recovery chamber (16) to the pumping circuit.

Figure 2:
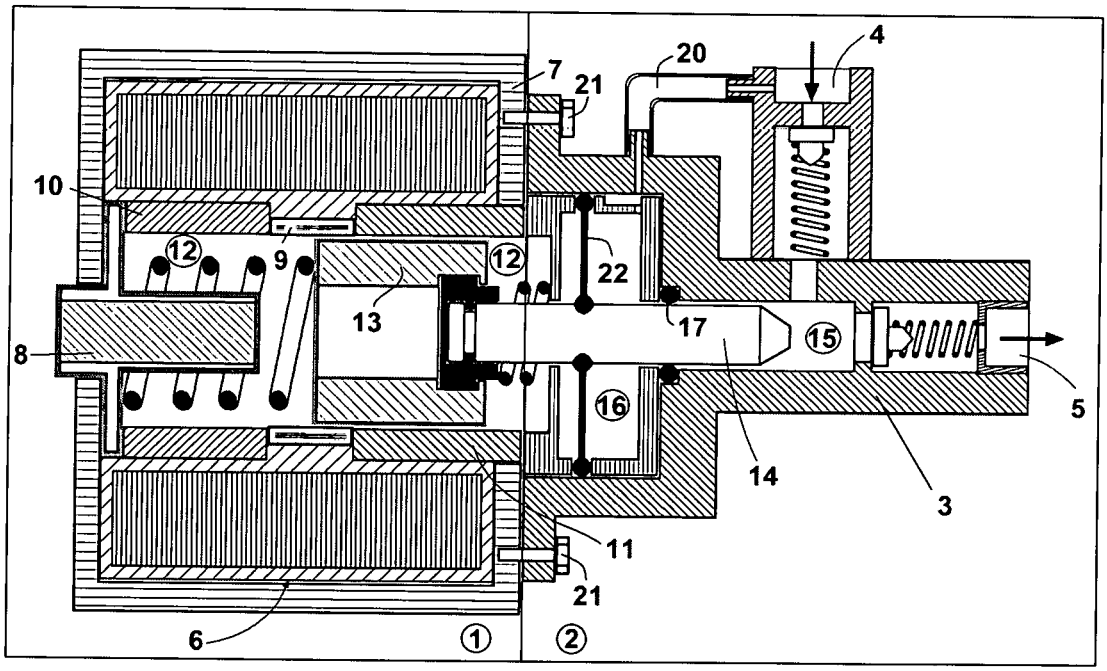
FIG. 2 shows a schematic drawing of an exemplary embodiment of the vibrating pump for liquids with membrane according to the invention, sectioned by a vertical plane.

In the exemplary embodiment shown in FIG. 2, the leak recovery chamber (16), which is limited by the pressure seal (17) on the right-hand side and by the membrane (22) on the left-hand side, recovers any water losses from the compression chamber (15) and conduct it through the conduit (20) to the inlet (4) of the compression chamber (15) which by suction re-injects the water present in the leak recovery chamber (16) inside the pumping circuit.

Figure 3:
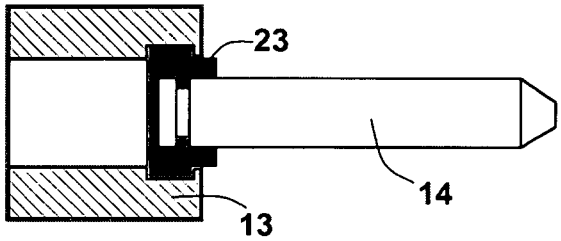
FIG. 3 shows a schematic drawing of an exemplary embodiment of the over-molded pumping means, according to the invention, sectioned in a vertical plane.

In the exemplary embodiment shown in FIG. 3 the pumping means is composed of a core (13) made of a ferromagnetic material and a plunger (14) attached to said core (13) by over-moulding with a plastic material (23) resulting in a single piece. The plunger (14) is made of ceramic material.

Figure 4:
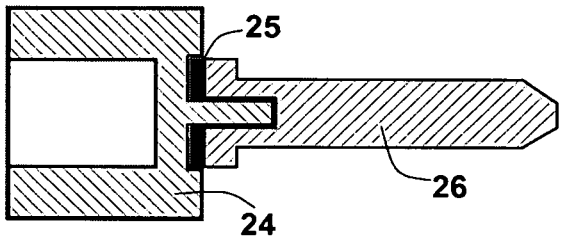
FIG. 4 shows a schematic drawing of an exemplary embodiment of the glued pumping means according to the invention, sectioned in a vertical plane.

In the exemplary embodiment shown in FIG. 4 the pumping means is composed of a core (24) made of ferromagnetic material, a plastic washer (25) and a plunger (26) attached to said core (24) by contact cement constituting a single piece. The plunger (26) is made of ceramic material.

Having described the nature of the invention sufficiently, as well as a preferred version, it is stated for the appropriate purposes that the materials, shape, size and arrangement of the elements described can be changed, provided this does not involve an alteration of the essential features of the invention claimed below.

The invention claimed is:

1. A vibrating pump for displacement of liquids, the pump comprising: a hydraulic system consisting of a hydraulic head with an inlet and an outlet for liquid, said hydraulic head being joined by screws to an electromagnetic system composed of a metal frame which is mounted to a rear bolt and which is situated around a coil and a plurality of bushings so as to form a force chamber therein, wherein a magnetic core is positioned between two springs and moves in axial direction in a reciprocating motion, said magnetic core being coupled to a plunger disposed inside a compression chamber, the plunger extending through a leak recovery chamber, characterized in that: the leak recovery chamber, which is delimited by a pressure seal on one side and by a membrane on an opposite side, recovers any loss of liquid from the compression chamber and conducts it through a conduit directly to the inlet of the compression chamber, the inlet drawing in and re-infusing the liquid from the leak recovery chamber back into the compression chamber.

2. The vibrating pump of claim 1, wherein a pumping means is composed of the magnetic core, which is made of ferromagnetic material and the plunger, the plunger being made of ceramic material, wherein the magnetic core and the plunger are joined by an over-molding process with a plastic material so as to form a single piece.

3. The vibrating pump of claim 1, wherein a pumping means is composed of the magnetic core, which is made of ferromagnetic material, a washer made of plastic material, and the plunger, wherein the plunger is made of ceramic material, wherein the magnetic core, the washer, and the plunger are glued by contact cement so as to form a single piece.

* * * * *